US007487970B1

(12) United States Patent
Ko

(10) Patent No.: US 7,487,970 B1
(45) Date of Patent: Feb. 10, 2009

(54) PAI-GOW POKER GAME

(75) Inventor: Bernard Chung Bon Ko, San Jose, CA (US)

(73) Assignee: TAJA Enterprises LLC, Incline Village, NV (US)

( * ) Notice: Subject to any disclaimer, the term of this patent is extended or adjusted under 35 U.S.C. 154(b) by 0 days.

(21) Appl. No.: 10/947,188

(22) Filed: Sep. 21, 2004

(51) Int. Cl.
*A63F 1/00* (2006.01)

(52) U.S. Cl. ..... 273/292

(58) Field of Classification Search ..... 273/292; 292/292

See application file for complete search history.

(56) References Cited

U.S. PATENT DOCUMENTS 5,226,661 A * 7/1993 Wolf ..... 273/274
5,248,142 A * 9/1993 Breeding ..... 273/138.1
5,314,194 A * 5/1994 Wolf ..... 273/292
5,397,128 A 3/1995 Hesse et al.
5,503,401 A * 4/1996 Nguyen ..... 273/306
5,529,309 A 6/1996 Bartlett
5,540,444 A * 7/1996 Nguyen ..... 273/292
5,560,613 A * 10/1996 Nguyen ..... 273/292
5,584,486 A * 12/1996 Franklin ..... 273/292
5,607,161 A * 3/1997 Skratulia ..... 273/292
5,645,281 A 7/1997 Hesse
5,685,774 A 11/1997 Webb
5,725,216 A 3/1998 Jones
5,803,460 A 9/1998 Hesse
5,863,041 A * 1/1999 Boylan et al. ..... 273/292
6,007,424 A 12/1999 Evers et al.
6,012,720 A 1/2000 Webb
6,050,569 A 4/2000 Taylor
6,070,876 A 6/2000 Ko
6,105,964 A 8/2000 Maahs
6,135,453 A * 10/2000 Srichayaporn ..... 273/292
6,135,454 A 10/2000 Mostashari
6,270,078 B1 * 8/2001 Leone et al. ..... 273/292
6,332,614 B1 12/2001 Hesse
6,394,456 B1 5/2002 Long
6,402,147 B1 * 6/2002 Lo ..... 273/292
6,409,174 B1 6/2002 Demarest
6,474,646 B1 * 11/2002 Webb ..... 273/274
6,481,717 B1 * 11/2002 Richardelle ..... 273/292
6,491,302 B1 * 12/2002 Boylan et al. ..... 273/292
6,503,145 B1 * 1/2003 Webb ..... 463/16
6,511,071 B1 1/2003 Artle et al.
6,719,291 B1 4/2004 deKeller
6,811,153 B1 * 11/2004 Ko ..... 273/292
6,840,517 B2 * 1/2005 Snow et al. ..... 273/292
7,044,468 B2 5/2006 Sklansky et al.
7,070,505 B2 7/2006 Vancura et al.
7,147,227 B2 12/2006 Taghavi
7,195,244 B1 3/2007 Feola (Continued)

OTHER PUBLICATIONS

Co-pending U.S. Appl. No. 12/247,172, filed Oct. 7, 2008 entitled "Wagering method including a reverse bet.".

(Continued)

*Primary Examiner*—Gene Kim
*Assistant Examiner*—Dolores Collins
(74) *Attorney, Agent, or Firm*—Lewis and Roca LLP

(57) ABSTRACT

An improved method for playing Pai Gow poker that allows for designated player/dealer bets. A designated player/dealer bet being that a bank hand will beat a particular player hand in accordance with the rules of Pai-Gow poker.

13 Claims, 6 Drawing Sheets

U.S. PATENT DOCUMENTS

| | | | | |
|---|---|---|---|---|
| 2005/0029742 | A1 * | 2/2005 | Snow | 273/274 |
| 2005/0170875 | A1 * | 8/2005 | Snow | 463/13 |
| 2006/0055112 | A1 * | 3/2006 | Lean et al. | 273/292 |
| 2006/0084505 | A1 * | 4/2006 | Yoseloff et al. | 463/42 |
| 2007/0235939 | A1 | 10/2007 | Ko et al. | |

OTHER PUBLICATIONS

Examiner is notified of office communication (Mail date Dec. 31, 2007) associated with co-pending U.S. Appl. No. 11/254,563 entitled "Wagering Method Including a Reverse Bet" filed Oct. 19, 2005.

Examiner is notified of a final office communication (Mail date Oct. 2, 2008) associated with co-pending U.S. Appl. No. 11/254,563 entitled "Wagering Method Including a Reverse Bet" filed Oct. 19, 2005.

Examiner is notified of office communication (Mail date Oct. 7, 2008) associated with co-pending U.S. Appl. No. 11/733,878 entitled "Wagering Method Including a Push Bet" filed Apr. 11, 2007.

Co-pending U.S. Appl. No. 11/254,563, filed Oct. 19, 2005 entitled Method for Adding Qualifier to Casino Games.

Co-pending U.S. Appl. No. 11/697,029, filed Apr. 5, 2007 entitled Method for Adding Qualifier to Casino Games.

* cited by examiner

PAI-GOW POKER GAME

FIELD OF THE INVENTION

This invention relates to Pai-Gow poker. More specifically, this invention relates to a new betting system that allows bets as to whether a designated player/dealer hand will be beat a specific player hand. Still more specifically, this invention relates to a manner for placing bets on the table prior to play of a hand and a method for paying out the bets from multiple designated player/dealer.

PRIOR ART

Pai-Gow poker is a popular game in many casinos and card houses in this country. In many casinos and card houses, it is a problem to find new ways to allow betting in order to keep players interested in the game when the player is either limited to the amount that can be bet on a particular hand or the hands at the position that the player is sitting are not winning compared to a designated player/dealer hand. For purposes of this application, a designated player/dealer is a player position that all other players will compare played hands to determine the outcome of the bets. Typically, the designated player/dealer must pay out all winning bets and gets to collect all losing bets. Furthermore, a primary designated player/dealer will be used as the term for the player at the player position that sets the designated player/dealer hand and secondary designated players/dealers will be used to describe third parties that cover the bets after the stake amount that the primary designated player/dealer has provided to cover bets has been expended. For purposes of this discussion, a third party means an entity other than a primary designated player/dealer of the hand and the players playing hands at a particular table. A third party may include, but is not limited to, the house, a player, or a proposition player as allowed in some jurisdictions including California.

One problem with providing new ways of betting is the gaming laws in various jurisdictions. In many jurisdictions, the use of third parties to place bets or act as a house or provider is prohibited or severely restricted. In these jurisdictions, it is preferable for any entity involved in the exchange of bets to be a direct participant in the betting. Thus, there is need in the art for a method of playing Pai-Gow poker that increases the numbers of bets available on a particular game while complying with the laws in a particular jurisdiction.

SUMMARY OF THE INVENTION

The above and other problems are solved and an advance in the art is made by an improved Pai-Gow poker game in accordance with this invention. A first advantage of a Pai-Gow poker game in accordance with this invention is that the game allows for many more bets to be placed on played hands by allowing players and a designated player/dealer to place bets as to whether a designated player/dealer hand will beat a particular player hand. A second advantage in accordance with this invention is that all bets are placed on a game table prior to play. Thus, no money is exchanged between designated player/dealers players and third parties prior to a hand being completed. A third advantage is that buy bets and color buy bets are eliminated which speeds up the game by eliminating transaction times.

The above and other advantages are provided by the improved Pai-Gow poker game played in the following manner in accordance with the present invention. The game is played on a table having a row of betting plays in front of every player position on the table for designated player/dealer bets. A designated player/dealer bet is a bet that the designated player/dealer hand will beat the player hand at the player position. A designated player/dealer bet plays against a designated player/dealer bet fund which pays and/or collects designated player dealer bets. Players or third parties may make bets into the designated player dealer bet fund when bets are made for other players or as house rules dictate. The location of the designated player dealer bet fund may be determined by house rules or by laws of a jurisdiction. Another space may also be provided for a proposition bet that the player hand at the position will push with the designated/player dealer hand.

In accordance with an exemplary embodiment of a Pai-Gow poker game of this invention, players place bets in front of each player position on which the player desires to place a bet excluding the player position of the designated player/dealer. Then, each designated player/dealer is allowed to place player bets and designated player/dealer bets in front of player positions having hands being played. Players may then be allowed to place designated player/dealer bets on any player hand excluding the position of the designated player/dealer. A hand is then played in accordance with the rules of Pai-Gow poker. After the hands are played, determinations are made as to which bets have won and all bets are paid or collected. Bets are paid out or collected by comparing the remaining stake of a current designated player/dealer to the amount of each bet. When a stake of a designated player/dealer is exhausted, the stake of a secondary designated player is used. This process is repeated until all player bets are settled. A designated player dealer bet fund is then used to pay the designated player/dealer bets. The designated player/dealer fund is typically a pool of separate funds provided by other players and third parties. In order to encourage secondary designated player dealers to participate or to encourage a primary designated player/dealer to stake a larger amount, the payout of the bet may be adjusted to less than or more than 1:1.

BRIEF DESCRIPTION OF THE DRAWINGS

The above and other features and advantages of this invention are described in the following detailed description and shown in the following drawings.

DETAILED DESCRIPTION

Figure 1:
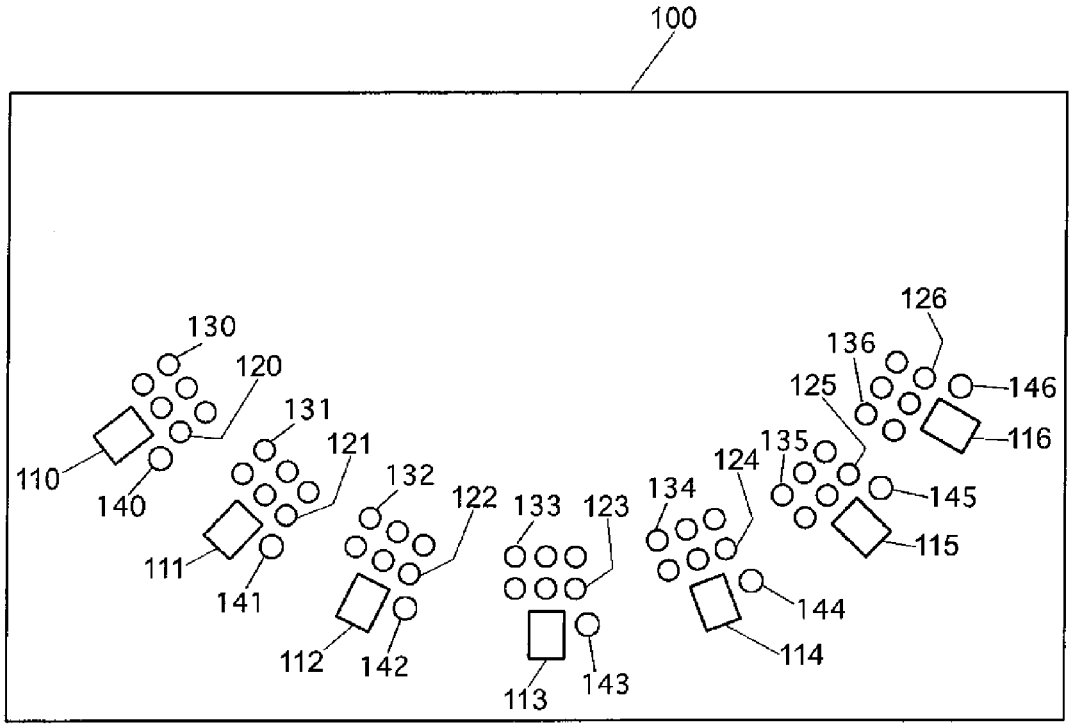
FIG. 1 illustrating a playing table for Pai-Gow poker in accordance with an exemplary embodiment of this invention.

This invention relates to an improved system for Pai-Gow poker. This invention is described below in a manner that allows one skilled in the art to use a system in accordance with this invention. When possible, like reference numerals have been used in the accompanying figures to describe the same or like elements of this invention.

This invention relates to a new method for playing a hand of Pai-Gow poker and a playing table for playing a hand of Pai-Gow poker in accordance with this invention. In accordance with this invention, a designated player/dealer may bet on individual hands that the designated player/dealer hand will beat a particular player.

FIG. 1 illustrates a top of a playing table 100 used to play a hand in accordance with an exemplary embodiment of this invention. Playing table 100 has seven marked player positions 110-116. One position will be designated a designated player/dealer position 113. One familiar with Pai-Gow poker will recognize that the designated player/dealer position may change after a certain number of hands. Alternatively, the designated player/dealer position may be on an opposite side of the table from six player positions if there is one house designated player/dealer. Furthermore, although shown as rectangles, player positions 110-116 may include rectangles that are substantially perpendicular to one another, with one rectangle being a place for an up hand and the second rectangle being for a back hand. Alternatively, the player positions may be any other shape or indicia that a designer sees fit to use.

In front of each player position 110-116 is a first row 120-126 of markers for placing player bets. There may be one marker that is generally a circle printed on the table surface in front of the player position. Alternatively, the first row 120-126 may include multiple circles printed on the table. One skilled in the art will recognize that although circles are used, any other shape or indicia may be used to show the player positions. A player may place a bet of up to a maximum amount in each circle. The use of multiple circles may allow multiple players to bet on a particle player hand or may be used to determine which designated player/dealer is playing against a particular bet as described below.

In accordance with this invention, each player position 110-116 also has a second row 130-136 of markers for placing designated player/dealer bets. There may be one marker that is generally a circle printed on the table surface in front of the player position. Alternatively, the second row 130-136 may include multiple circles printed on the table. Furthermore, although shown as circles, any other shape or indicia may be used to show each bet position. A designated player/dealer may place a bet of up to a maximum amount in each circle. The use of multiple circles may allow multiple designated player/dealers to bet against a particular player hand or may be used to determine which third party and or particular designated player/dealer is playing against a particular bet as described below.

The second row 130-136 of the player position of the designated player/dealer may be used to place or hold individual funds in a designated player/dealer bet fund. Each individual fund may be placed by separate third parties. The designated player bet fund covers the action on designated player/dealer bets placed on the table in second row 130-136.

In some embodiments, there may be a proposition marker 140-146 proximate each player position 110-116. The marker may be to the side of the card positions and used to place a proposition bet. In accordance with these embodiments, a proposition bet is a bet that a particular outcome of the game or a hand will occur in accordance with rules of the game in the establishment that the game is being played. For example, one bet may be that a player hand at a particular player position will push with the designated player/dealer hand. The proposition marker of the player position of the designated player dealer may be used to place the amount that any designated player/dealer places to cover the proposition bets of players. House rules decide who will cover the action for proposition bets.

Figure 2:
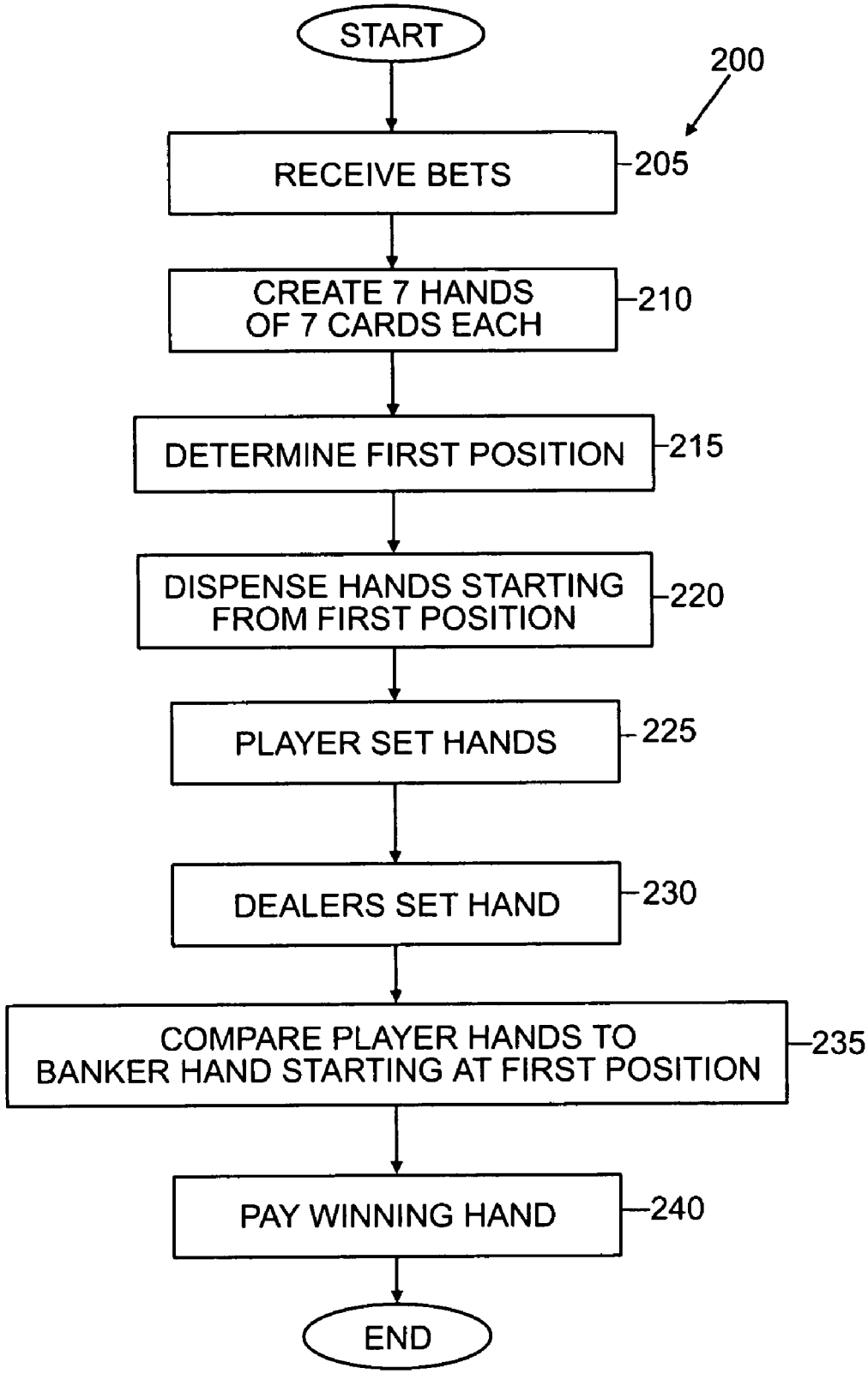
FIG. 2 illustrating a method for playing a hand of an improved Pai-Gow poker game in accordance with an exemplary embodiment of this invention.

FIG. 2 illustrates an overview of a method for playing a hand of Pai-Gow poker in accordance with this invention. Method 200 begins in step 205 by receiving bets. In step 205, the players place bets on whether a hand played at a particular player position 110-116 will beat a designated player/dealer hand. In some variations of the game, a player may only place a player bet on a hand at the player position 110-116 where the player is playing. In other variations, a player may place a player bet on the hand at any player position being played excluding the designated player dealer. Some jurisdictions and house rules may allow a player to place bets on hands not being played by a player. The unplayed hands may be set according to house rules.

After the players have placed all of the player bets, the designated player/dealers may place player bets and designated player/dealer bets at the player positions having a hand being played. One skilled in the art will recognize that in some embodiments, the designated player/dealer may place bets on all player positions regardless of whether a player is playing at the position. In these cases house rules may be used to set the hand not being played by a player. A designated player/dealer bet is a bet that the designated player/dealer hand will beat a particular player hand. Each entity that is acting as a designated player/dealer has a chance to place designated player/dealer bets. In some embodiments, the players may be allowed to place designated player/dealer bets after all of the designated player/dealers have completed placing bets. An exemplary process for placing player and designated player/dealer bets is described in FIG. 3.

After the bets are all placed, the designated player/dealer uses a randomized deck of playing cards to deal seven hands of seven cards each in step 210. One skilled in the art will recognize that more than one deck of playing cards or one or more altered decks of playing cards may be used to allow more or less than seven hands to be played or to change the odds of the game. In accordance with the rules of Pai-Gow poker, each deck of cards used in a game includes four suits having thirteen cards each (two-Ace) and at least one joker (preferably two Jokers). Although, it is conceivable not to include jokers in each deck. There are at least three cards discarded per deck of cards used in play of a game. The number of cards discarded will vary depending on the number of Jokers used per deck of cards. The discarded cards are not shown to the players. The game may also be played with a joker's wild.

In step 215, a first position is determined. The determination may be by rolling dice or by an electronic random number generator that is shown on a display. Any other way may be used since this is not important to the play of a hand in accordance with this invention. When the first position is determined, a marker is set at the first position. This marker is used to determine which designated player/dealer is covering a bet when multiple designated player/dealers are covering the action in a hand as described below.

In step 220, the seven hands are dispensed to the six player positions and the designated player/dealer. The first hand is dispensed to the player position determined to be the first position in step 215. The remaining hands are then dispensed to the other player positions and the designated player/dealer in order. One order may be clock-wise around the table. A second way is counter clock-wise around the table. All seven hands are dispensed, even to player positions where no players are playing a hand.

After the cards are dispensed, each player sets an upper hand of two cards and lower hand of five cards in accordance with the rules of Pai-Gow poker in step 225. The players then lay the two hands on the table. It should be appreciated that in some establishments there is a house way including rules that a player must use in setting a player hand. After the player hands are set, the designated player/dealer sets the designated/player dealer hand in step 230. Traditionally, all cards in the designated player/dealer hand are placed face up on the table and arranged into a two-card upper hand and a five card lower hand. It should be appreciated that in some establishments there is a house way including rules that a designated player/dealer must use in setting the designated player/dealer hand. One skilled in the art will also recognize that if more than one person is providing the pot for bets, there may be house rules as to which designated player/dealer sets the designated player/dealer hand.

Figure 4:
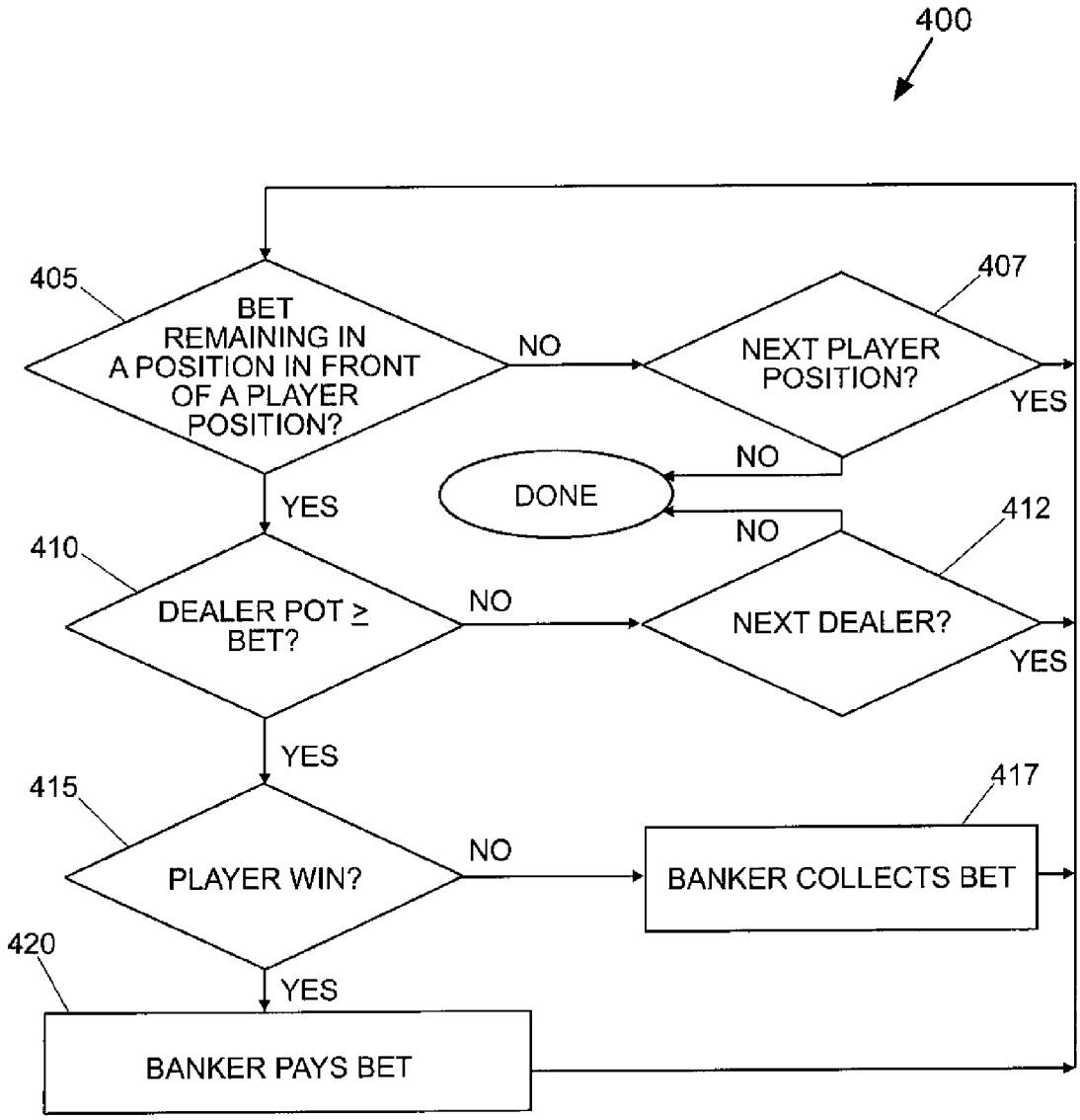
FIG. 4 illustrating a method for paying players in the method for playing a hand of an improved Pai-Gow poker game in accordance with an exemplary embodiment of this invention.

After the designated player/dealer hand is set, the designated player/dealer hand is compared to the player hands starting at the first position and winning and losing bets are determined in step 235. The winning bets are then paid and losing bets collected in step 240 in accordance with this invention. FIG. 4 illustrates a method for paying and collecting bets in accordance with this invention.

Figure 3:
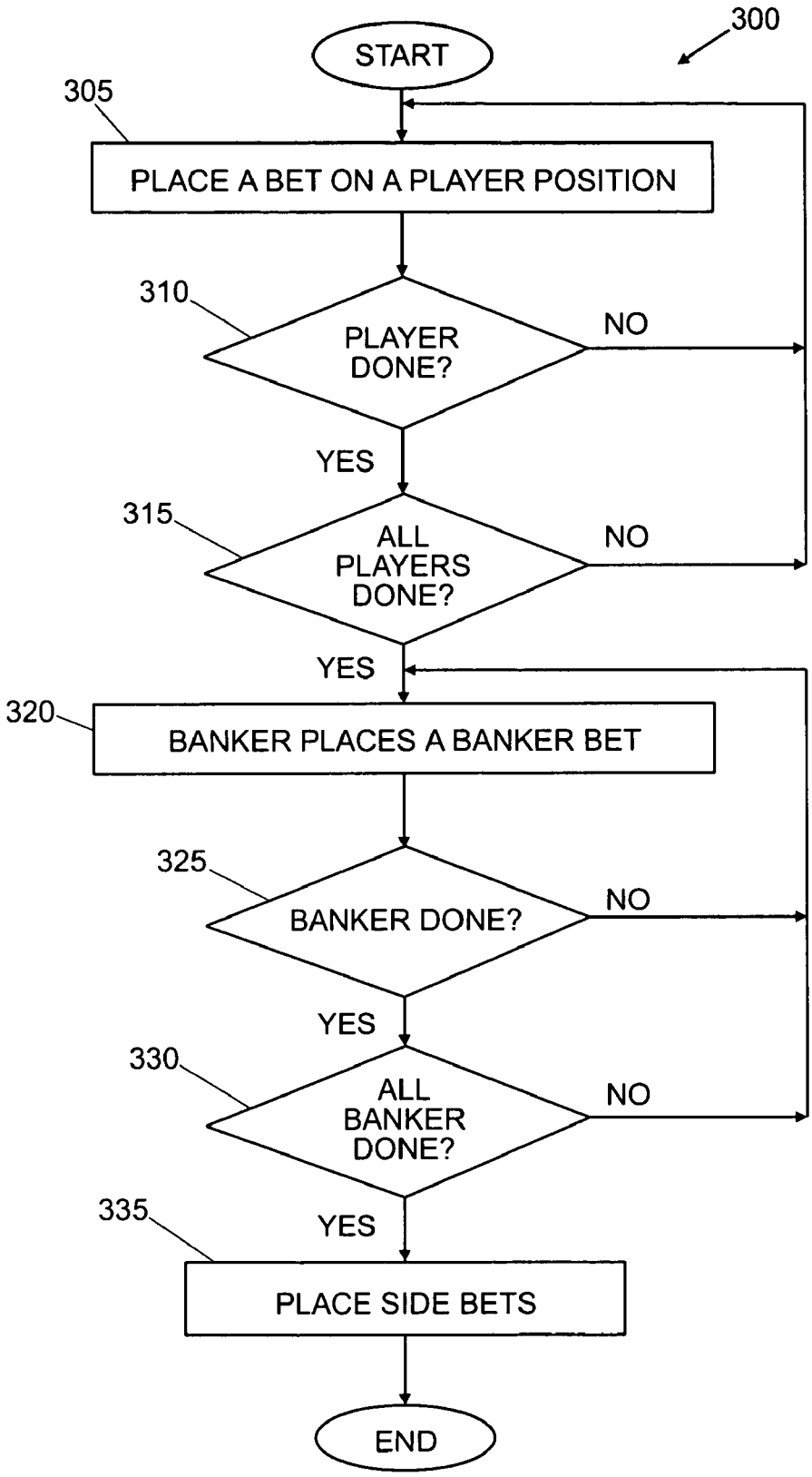
FIG. 3 illustrating a method for betting in the method for playing a hand of an improved Pai-Gow poker game in accordance with an exemplary embodiment of this invention.

FIG. 3 illustrates a process 300 for placing bets in an exemplary embodiment of a Pai-Gow poker hand in accordance with this invention. One skilled in the art will recognize other embodiments for placing bets may be used. Process 300 begins in step 305 with each player placing bets in the player position that a player is betting. In step 310, it is determined whether the player is done betting. If not, process 300 returns to step 305 to allow players to place additional bets on the hand at the player position.

If the player is done betting on the hand the player is playing, it is determined if the player is done betting in step 315. If not process 300 returns to step 305 and the player is allowed to bet on hands at other player positions being played, excluding the player position of the player acting as the designated player/dealer.

If all players are done betting in step 315, a primary designated player/dealer is allowed to place a designated player/dealer bet at player positions being played in step 320. In step 325, it is determined whether the primary designated player/dealer is finished placing designated player/dealer bets. If the primary designated player/dealer is not done betting, process 300 returns to step 315. If designated player/dealer is done betting, it is determined whether there is another designated player/dealer wishing to bet in step 330. If there is a secondary designated player/dealer wishing to bet, steps 320-330 are repeated for the secondary designated player/dealer. These steps are repeated until all secondary designated player/dealers are done betting. When the designated player/dealers are done betting, proposition bets, including the push bet, may be placed on the table in step 335. In some embodiments, players are then allowed to place designated player/dealer bets. After all bets have been placed process 300 ends.

FIG. 4 illustrates a process 400 for paying player bets in step 240 of FIG. 2. Process 400 begins in step 405 by determining whether there is player bet in front of the first position. If there is a player bet in front of the first player position, the amount of the bet is compared to an amount placed to cover bets of a current designated player/dealer in step 410. Otherwise, process determines if there is a next player position being played in step 407. If there are no more player positions with player bets remaining, process 400 ends. Otherwise, process 400 is repeated from step 405 for the next player position.

In step 410, the amount of the player bet is compared to the amount of the remaining funds of the current designated player/dealer. If the remaining stake is greater than the player bet, the current designated player/dealer is playing against the bet and the amount of the bet is subtracted from the remaining funds. Process 400 then continues to step 415. Otherwise, it is determined if there is another designated player/dealer for the hand in step 412. If there is not another designated player/dealer process 400 ends. Otherwise process 400 is repeated from step 405 with the next designated player/dealer becoming the current designated player/dealer.

In step 415, it is determined whether the hand at the current position beats the designated player/dealer hand in accordance with the rules of Pai-Gow poker. If the player hand beats the designated player/dealer hand, the current designated player/dealer pays the bet in step 420 and process 400 returns to step 405 for the next bet to be determined. One skilled in the art will recognize that the ratio of a pay out of a bet may be adjusted to be more than or less than 1:1. This may be done to encourage a designated player/dealer or a player to provide a larger bet. If the player loses, the current designated player/dealer collects the bet in step 417 and process 400 returns to step 405. One skilled in the art will note that in some jurisdictions the bets collected are not added to the stake of the designated player dealer. However, the amount collected could be added to the stake of the designated player/dealer if house rules and laws of the local jurisdiction permit. If there is a push, process 400 returns to step 405 to determine the next bet. Depending on house rules a push may or may not count as action against a wager of a designated player/dealer.

At this time all proposition bets can be paid by the current designated player/dealer in the same manner as described above. Traditionally, proposition bets were based upon the cards received in a particular hand. However, in accordance with some embodiments of this invention, proposition bets may include bets as to the results of the game. Some examples include, but are not limited to whether a particular player hand pushes with the designated player/dealer hand and whether the designated player dealer beats a certain number of player hands. The amount paid on a particular proposition bet may be greater that or less than 1:1 in order to induce betting and in order to encourage players to make a proposition bet and to encourage the covering of proposition bets.

Figure 5:
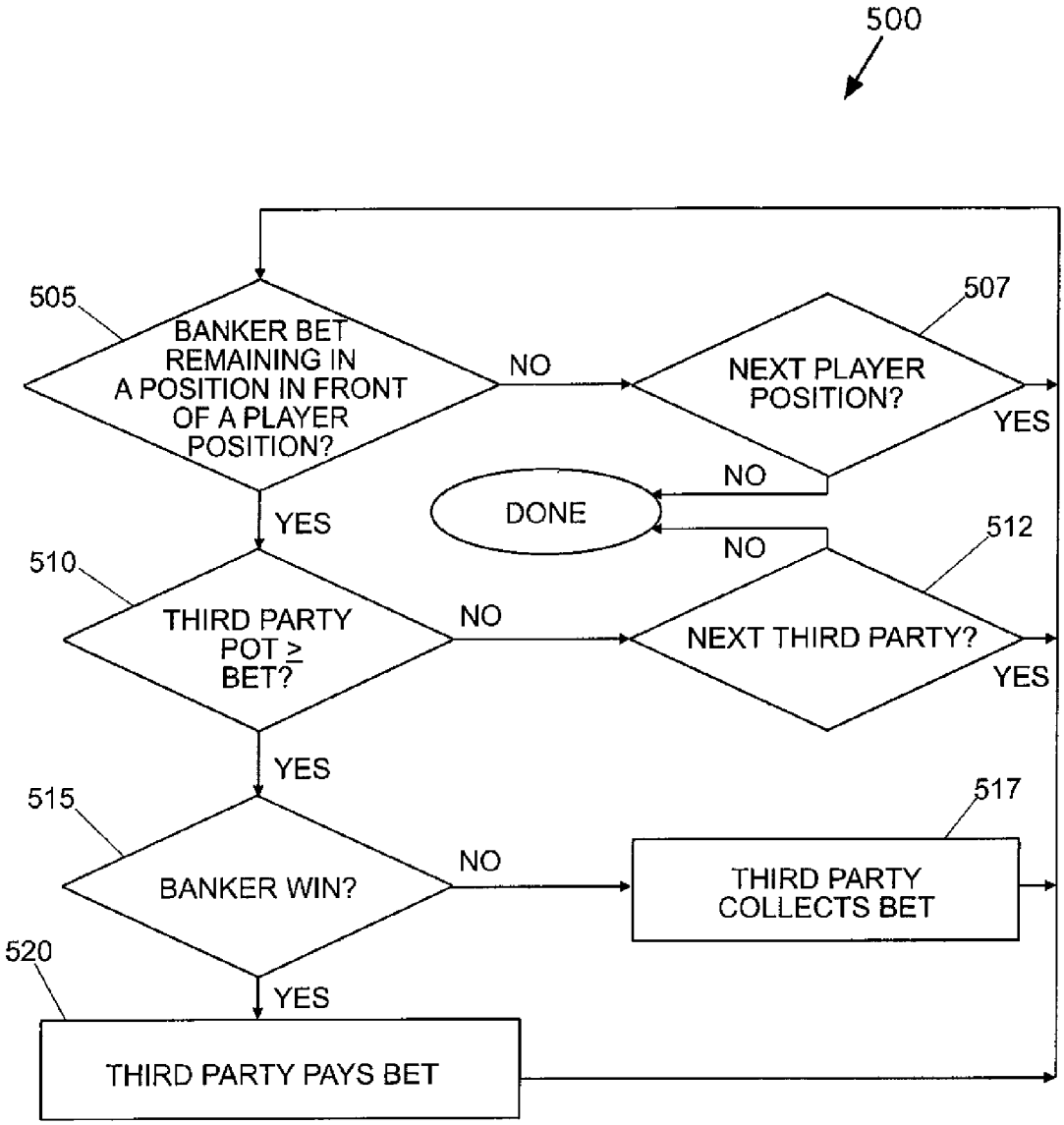
FIG. 5 illustrating a method for paying designated player/dealers in the method for playing a hand of an improved Pai-Gow poker game in accordance with an exemplary embodiment of this invention.

FIG. 5 illustrates a process 500 for paying designated player/dealer bets in step 240 of FIG. 2. Process 500 begins in step 505 by determining whether there is designated player/dealer bet in front of the first position. If there is a designated player/dealer bet in front of the first player position, the amount of the bet is compared to the amount remaining in the current individual fund in a designated player/dealer bet fund in step 510. The parties that may provide individual funds in the designated player/dealer bet fund may be governed by house rules and laws of a local jurisdiction. It is envisioned that only third parties will be allowed to place individual funds in the designated player/dealer bet fund by placing chips in the designated player/dealer bet spots on the table in front of the player position of the designated player/dealer in a preferred exemplary embodiment. Furthermore, there may be house rules set that determine which individual fund from the designated player/dealer bet fund is used to wager against a particular party that has placed a designated player/dealer bet to ensure a party is not betting against an individual fund of the party in the designated player/dealer spot.

Otherwise, process determines if there is a next player position being played in step 407. If there are no more player positions with designated player/dealer bets remaining, process 500 ends. Otherwise, process 500 is repeated from step 505 for the next player position.

In step 510, the amount of the designated player/dealer bet is compared to the amount in the current individual fund in the designated player/dealer bet fund. If the amount in the individual fund is greater than the designated player/dealer bet, the current individual fund is playing against the designated player/dealer bet and the amount of the bet is subtracted from the current individual fund. Process 500 then continues to step 515. Otherwise it is determined if there is another individual fund in the designated player/dealer bet fund that is great enough to cover all or part of the designated player/dealer bet for the hand in step 512. If there is not another individual fund great enough to cover all or part the bets, process 500 ends. Otherwise process 500 is repeated from step 505 with the next individual fund from the designated player/dealer bet fund becoming the current individual fund.

In step 515, it is determined whether the player hand at the current player position loses to the designated player/dealer hand in accordance with the rules of Pai-Gow poker. If the designated player/dealer hand beats the player hand, the current individual fund pays the bet in step 520 and process 500 returns to step 505 for the next designated player/dealer bet to be determined. If the designated player/dealer hand loses, the individual fund collects the bet in step 517 and process 500 returns to step 505. In a preferred embodiment, the amount of the bet collected is not added to the amount of the fund to determine whether the current individual fund covers the next designated player/dealer bets. However, the amount could be added if house rules and laws of the local jurisdiction permit. If there is a push, process 500 returns to step 505 to determine the next bet. After process 500 ends, all propositional bets can then be paid by the designated player dealer or other party covering the propositional bets.

Figure 6:
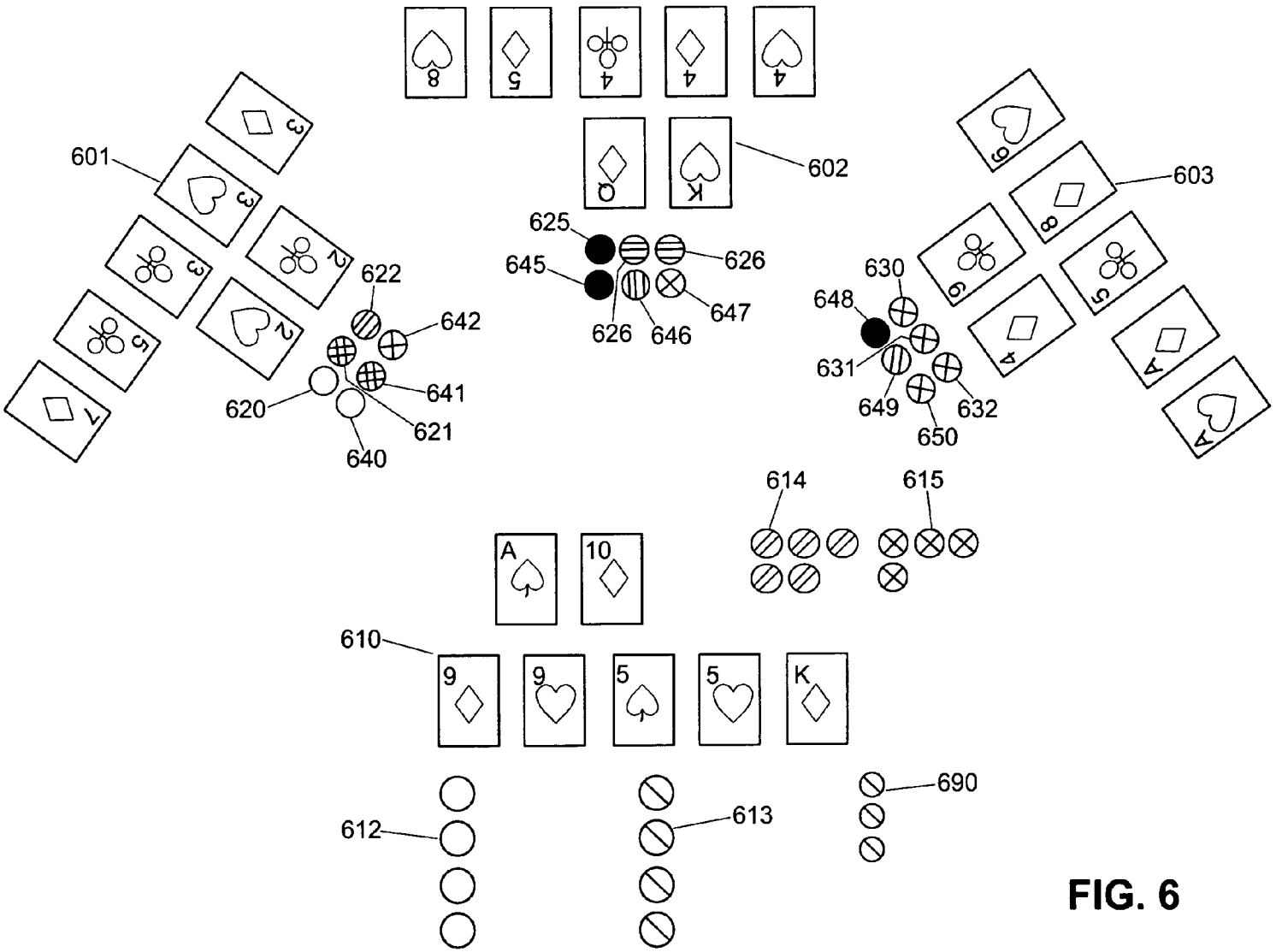
FIG. 6 illustrating an exemplary hand of Pai-Gow poker played in accordance with an exemplary embodiment of this invention.

FIG. 6 illustrates an example of a hand being completed in accordance with a Pai-Gow poker game in accordance with this invention. For simplicity and clarity of the description, only three player hands and a designated player/dealer hand are shown and all bets are assumed to pay 1:1. In this example, pushes count against a designated player/dealer as action. The hand in first player position 601 beats designated player/dealer hand 610. The hand in second player position 602 pushes with designated player/dealer hand 610. Finally, the hand at third player position 603 loses to designated player/dealer hand 610.

The process of paying the bets begins after designated player/dealer hand 610 is set and displayed. The player bets at first player position 601 are paid and collected. At first player position 601, a pair in the upper hand beats the ace and ten in the upper hand of the designated player/dealer and the three threes beat the pair of nines and pair of fives in the bottom hand of the designated player/dealer. First, it is determined bet 620 is one chip. Since the pot of first designated player/dealer 612 is three chips, the first designated player/dealer is playing against first bet 620 and must pay first bet 620. Thus, first designated player/dealer has two chips remaining in the pot. This is repeated for player bets 621 and 622.

After paying bets 621 and 622, the first designated player/dealer has no chips remaining in the pot. It should be noted that the three bets may be made by up to three different player with a different bet for each player. Alternatively, there may be a cap on the maximum amount for a bet and the player at this position may be making three different bets where at least two of the bets are for the maximum amount.

After bets 620-622 are paid at first player position 601, the process moves to second player position 602. At second player position 602, the upper hand of a King and a Queen loses to the upper hand (Ace-ten) of the designated player/dealer hand. However, the lower hand having three fours beats the two pairs of the lower hand of the designated player/dealer. Thus, second hand 602 pushes with designated player/dealer hand 610.

First bet 625 in second player position 625 is one chip. However, first designated player/dealer pot 602 has zero chips remaining. Thus, the process moves to the second designated player/dealer pot that has four chips. Thus, the second designated player/dealer is playing against first bet 625 of the second hand. Since second hand 602 pushes with designated player/dealer hand 610, no chips are exchanged on the bet. This process is repeated for second player bet 626 and third player bet 627. Thus, after the determination of the player bets at second player position 602, second designated player/dealer pot 613 has one chip remaining as the amount of each bet is subtracted from the pot and bets won are not added in this exemplary embodiment.

Third player hand 603 has an upper hand of a Jack and a nine which loses to the upper hand of designated player/dealer hand 610 (Ace-ten). The lower hand of third player position 603 has a pair of Queens that loses to the two pairs of designated player/dealer hand 610. Thus, third player position 603 loses to designated player/dealer hand 610.

The paying of the player bets for third player position 603 is handled in the following manner. There is a first bet 630 of one chip. Second designated player/dealer pot 613 has one chip remaining. Thus, second designated player/dealer pot 613 is covering player bet 630. Thus, second designated player/dealer 613 collects first bet 630. In this embodiment, a collected bet is not added to the pot of designated player/dealer 613. Second bet 631 is one chip. However, second designated player/dealer has no chips remaining. Thus, third designated player/dealer 690 is covering the bet. This is because designated player/dealer 690 has three chips. Thus, designated player/dealer 690 collects the bet. In this embodiment, the amount collected is not added to the pot of designated player/dealer 690. Third bet 633 is one chip. Third designated player/dealer 690 has two chips remaining and covers the bet. Thus, designated player/dealer 690 collects the bet. In this embodiment, the amount collected is not added to the pot of designated player/dealer 690.

After the player bets have been determined, the designated player/dealer bets are determined. At first player position 601, a pair of two in the upper hand beats the Ace and ten in the upper hand of the designated player/dealer and the three threes beat the pair of nines and pair of fives in the bottom hand of the designated player/dealer. Thus, the designated player/dealer bet loses this hand since a designated player/dealer bet is a bet the designated player/dealer hand will beat the player hand. First, it is determined that first designated player/dealer bet 640 is one chip. Since the amount of the first individual fund 614 in the designated player/dealer bet fund is four chips, the first individual fund is playing against first designated player/dealer bet 640 and collects first bet 640. In this exemplary embodiment, the amount of the bet is then subtracted from the first individual which now has three chips remaining in the pot. This is repeated for designated player/dealer bets 641 and 642.

After collecting designated player/dealer bets 641 and 642, the first individual fund has one chip remaining in the fund. It should be noted that the three designated player/dealer bets may be made by up to three different designated player/dealers with a different bet for each designated player/dealer.

Alternatively, there may be a cap on the maximum amount for a bet and a designated player/dealer may be making three different bets where at least two of the bets are for the maximum amount.

After bets 640-642 are collected at first player position 601, the process moves to second player position 602. At second player position 602, the upper hand of a king and a Queen loses to the upper hand (Ace-ten) of the designated player/dealer hand. However, the lower hand having three fours beats the two pairs of lower hand of the designated player/dealer. Thus, second hand 602 pushes with designated player/dealer hand 610.

First bet 645 in second player position 625 is one chip. First individual fund 614 has one chip remaining after first position 601 designated player/dealer bets are determined. Thus, the first individual fund 614 in the designated player/dealer bet fund is playing against first bet 625 of the second hand. Since second hand 602 pushes with designated player/dealer hand 610. No chips are exchanged on the bet. After the first designated player/dealer bet 645 is determined first individual fund is expended. Thus, second individual fund 615 of the designated player/dealer bet funds is made into the current individual fund. The process is then repeated for second player bet 626 and third player bet 627. Thus, after the determination of the player bets at second player position 602, second individual fund 614 is still has three chips remaining. Since two chips are subtracted for play against designated player/dealer bets 626 and 627. The process continues to third player hand 603.

Third player hand 603 has an upper hand of a Jack and a nine which loses to the upper hand of bank hand 610 (Ace-ten). The lower hand of third player position 603 has a pair of Queens which loses to the two pairs of bank hand 610. Thus, third player position 603 loses to designated player/dealer hand 610.

The paying of the designated player/dealer bets for third player position 603 are handled in the following manner. There is a first designated player/dealer bet 648 of one chip. Second individual fund 615 has three chips remaining. Thus, second individual fund 615 is covering first designated player/dealer bet 648. Thus, second individual fund 615 pays first designated player/dealer bet 648. This is repeated with second bet 649 and third bet 650 with the second individual fund paying each of the bets. In this case, all of the designated player/dealer bets were covered by the funds in the designated player/dealer bet funds. However, there may be times when individual funds are depleted and some designated player/dealer bets go unplayed.

The above is a description of an improved Pai-Gow Poker game in accordance with this invention. However, it is envisioned that one skilled in the art may play with a system that infringes this invention as set forth in the following claims either literally or through the Doctrine of Equivalents.

What is claimed is:

1. A method for playing a hand of Pai-Gow poker comprising:

placing a designated player/dealer bet on a designated player/dealer hand beating a particular player position on a playing table in a position proximate said particular player position, wherein said particular player position is one of 6 player positions, and said designated player/dealer hand is the hand that all other players compare their hands to in order to determine the outcome of bets;

separating a deck of playing cards into 7 hands wherein each hand includes 7 cards;

determining a one of said 6 player positions and a designated player/dealer position to receive a first one of said seven hands;

dispensing said 7 hands to said 6 player positions and said designated player/dealer position according to rules of a Pai-Gow game responsive to a determination;

allowing a player at each of said 6 player positions having bets on said playing table to set an upper hand of two cards and a lower hand of five cards in accordance to rules of Pai-Gow poker;

allowing a designated player/dealer to set an upper hand of two cards and a lower hand of five cards of a designated player/dealer hand at said designated player/dealer position in accordance with rules of Pai-Gow poker;

determining whether said upper hand and said lower hand of said particular player position beats said upper hand and said lower hand of said designated player/dealer hand; and paying said designated player/dealer bet from a designated player/dealer bet fund if said particular player position has an upper hand that loses to said upper hand of said designated player/dealer hand and has a lower hand that loses to said lower hand of said designated player/dealer hand.

2. The method of claim 1 further comprising:

allowing at least one player to place a player bet on a player hand beating at least one of said 6 player positions on a playing table in a position proximate said at least one of said 6 player positions; and paying each said player bet from a designated player/dealer fund of each of said at least one of said 6 players positions that have an upper hand that beats said upper hand of said designated player/dealer hand and said lower hand of said designated player/dealer hand.

3. The method of claim 1 further comprising:

allowing a second designated player/dealer to place a designated player/dealer bet on a designated player/dealer hand beating at least one of said 6 player positions on a playing table in a position proximate said at least one of said 6 player positions.

4. The method of claim 3 further comprising:

allowing each player to place a designated player/dealer bet on at least one of said 6 player positions.

5. The method of claim 3 further comprising:

marking each said designated player/dealer bet from said first designated player/dealer with a first indicia; and marking each said designated player/dealer bet from said second designated player/dealer with a second indicia.

6. The method of claim 1 further comprising:

allowing each of a plurality of subsequent designated player/dealers to place a designated player/dealer bet on a designated player/dealer hand beating at least one of said 6 player positions on a playing table in a position proximate said at least one of said 6 player positions.

7. The method of claim 4 further comprising:

marking each said designated player/dealer bet from said first designated player/dealer with a first indicia; and marking each said designated player/dealer bet from said each of said plurality of subsequent designated player/dealers with a different indicia.

8. The method of claim 1 wherein said step of allowing said player to place a bet comprises:

allowing said player to place at most a maximum amount in each of a plurality places proximate said at least one of said six players positions when making said player bet for determining designated player/dealer payouts.

9. The method of claim 8 wherein said step of paying said player bets includes:

determining a one of said plurality of designated player/dealers banking a particular player bet based upon an amount of a pot of a one of said plurality of designated player/dealers and which one of said plurality of places proximate said at least one of said six players position that said player bet is placed.

10. The method of claim 1 wherein said step of allowing said player to place a bet comprises:

allowing said designated player/dealer to place at most a maximum amount in each of a plurality places proximate said at least one of said six players positions when making said designated player/dealer bet for determining third party pay outs.

11. The method of claim 10 wherein said step of paying said player bets includes:

determining a one of said plurality of individual funds in said designated player/dealer bet fund playing a particular designated player/dealer bet based upon an amount of said one of said plurality of individual funds and which one of said plurality of places proximate said at least one of said six players position that said designated player/dealer bet is placed.

12. The method of claim 1 further comprising:

allowing a player to place a proposition bet that a particular one of said six player positions will have a push hand in accordance with the rules of Pai-Gow poker.

13. The method of claim 12 further comprising:

paying said proposition bet responsive to a determination that said hand of said particular one of said six player positions pushed with said designated player/dealer hand.

* * * * *